US005890596A

United States Patent [19]

Albisetti

[11] Patent Number: 5,890,596

[45] Date of Patent: Apr. 6, 1999

[54] THERMOPLASTIC TRAY FOR MIXING AT LEAST TWO PRODUCTS AT TIME OF USE

[75] Inventor: Nicolas Albisetti, Clichy, France

[73] Assignee: L'Oreal, Paris, France

[21] Appl. No.: 55,901

[22] Filed: Apr. 7, 1998

[30] Foreign Application Priority Data

Apr. 14, 1997 [FR] France ..... 97 04545

[51] Int. Cl.[6] ..... B65B 77/00

[52] U.S. Cl. ..... 206/581; 206/559; 220/4.27

[58] Field of Search ..... 206/216, 557, 206/564, 559, 581; 220/23.86, 501, 502, 4.26, 4.27

[56] References Cited

U.S. PATENT DOCUMENTS 3,954,179 5/1976 Warmath .
5,351,818 10/1994 Daneshvar ..... 206/216
5,743,405 4/1998 Reid ..... 206/557 X

FOREIGN PATENT DOCUMENTS 1053868 1/1967 United Kingdom .
WO 95 11834 A 5/1995 WIPO .

*Primary Examiner*—Jacob K. Ackun
*Attorney, Agent, or Firm*—Oblon, Spivak, McClelland, Maier & Neustadt, P.C.

[57] ABSTRACT

A thermoplastic tray (1) for mixing, at the time of use, at least two products A and B, includes a thermoplastic body (2) forming at least two compartments (3, 4), a first compartment (3) containing the product A and a second compartment (4) containing the product B. Each of the compartments has an opening (8, 12) delimited by a peripheral edge (9, 14) and closed off in a removable manner by a cover (10, 15), the two compartments being connected together via at least one articulation zone (16). The articulation zone (16) makes it possible to bring a portion of the peripheral edge (14) of the second compartment (4) over the top of the opening (8) of the first compartment (3) by moving the second compartment (4) with a translational movement and then tilting the second compartment (4) so as to pour the product B into the first compartment (3) in order to mix the two products therein.

20 Claims, 4 Drawing Sheets

THERMOPLASTIC TRAY FOR MIXING AT LEAST TWO PRODUCTS AT TIME OF USE

BACKGROUND OF THE INVENTION

1. Field of the Invention

The present invention relates to a thermoplastic tray for mixing two products A and B at the time of use. The invention is most particularly suited to mixing hair-coloring products comprising a coloring agent and an oxidizing agent.

2. Description of the Related Art

In the field of hair coloring, use is made of a coloring agent and of an oxidizing agent which are packaged separately so that their properties are not affected, and which are mixed just prior to use. For products which are of a liquid consistency, there are mixers of a type with two compartments separated by a removable stopper. Actuating means expel the stopper prior to use in order to enable the coloring agent and the oxidizing agent to be mixed. Such devices are described in European patent no. 333,541 and in U.S. Pat. No. 1,275,315. These devices are often complicated and of a relatively high cost. Furthermore, they are particularly unsuitable when one or both of the components are in cream or powder form.

Still in the field of hair coloring, it is known to package such products inside two separate compartments. Prior to use, the user opens the first compartment and, after having opened the second compartment, pours the contents of the first compartment into the second and mixes them using a spatula, for example. Generally speaking, the two compartments are totally separate from each other, i.e,. they are not joined to each other. One of the problems with this type of product is linked to the handling of the container whose contents have to be added to the contents of the other container. Because of the highly unstable nature of the products, particularly when in contact with the air, it is necessary to fill them to maximum level in order to substantially eliminate any volume of air between the free surface of the product and the sealing cover. After opening, handling therefore becomes very awkward, owing to the risk of dropping some of the product. Furthermore, when the contents of the first container are poured into the second, particularly in the case of a liquid product, if the shape of the edge of the first container is not chosen suitably, a so-called "teapot" effect may arise during pouring, resulting in an inopportune flow of liquid along the edge of the first container, which, unless special precautions are taken, will flow outside the second container. Some of the product will thus be lost which, besides wastage and environmental pollution, may result in coloring of lower quality on account of the modification in the respective measured amounts of coloring agent and oxidizing agent.

In a completely different field, namely the foodstuffs field, it is known to produce a box which includes a base on which a lid is articulated. Such a box is described in French patent application FR-A-2,731,412. The hinge described for producing this box is sufficiently rigid to permit only a simple pivoting movement between the lid and the base. In fact, since the only function of the lid is to close off the opening of the receptacle in a removable manner, the only movement needed to produce this function is a pivoting movement, insofar as the lid in the open position has its base raised above the base of the receptacle containing the product. An articulation allowing a movement which includes other components would not satisfactorily guarantee this opening and closing function. On the other hand, owing to the single pivoting movement it allows, an articulation zone of this type could never be used for the articulation of a first container with a second whose contents have to be poured into the first container.

SUMMARY OF THE INVENTION

Therefore, one of the objects of the present invention is to provide a tray for mixing two products at the time of use and completely or partially to solve the problems mentioned above.

A particular object of the invention is to provide a device for mixing, by transferring the contents of a first container into a second container, this using simple, reproducible handling operations which are not likely to cause losses of product.

A further object of the invention is to provide a packaging which is economical to produce, in particular by using modern industrial techniques such as thermoforming or thin-wall injection.

According to the invention, these and other objects are achieved by producing a thermoplastic tray for mixing, at the time of use, at least two products A and B, the tray including a thermoplastic body forming at least two compartments of which a first compartment contains the product A and a second compartment contains the product B, each of the first and second compartments having an opening delimited by a peripheral edge and closed off in a removable manner by appropriate means, the two compartments being connected together via at least one articulation zone. The articulation zone makes it possible to bring at least a portion of the peripheral edge of the second compartment on top of the opening of the first compartment by moving the second compartment substantially in translation, and then tilting the second compartment so as to pour the product B into the first compartment in order to mix the two products therein.

Advantageously, the portion of the peripheral edge of the second compartment is brought on top of the opening of the first compartment by a movement which has a horizontal component and a vertical component, the second compartment having a lateral wall, of which a portion adjacent to the articulation zone is inclined so as to give the horizontal component greater amplitude. This also makes it possible, if appropriate, to facilitate demolding of the tray.

By way of indication, the angle formed by the lateral wall may be from 5° to 45° and preferably from 50° to 20°.

Preferably, the peripheral edge surrounding the openings forms a surface which is substantially parallel to a plane of the base of the first and second compartments and has, opposite the articulation zone, a first edge adjacent to the opening which it delimits and a second edge adjacent to the articulation zone. The articulation zone makes it possible to bring at least the second edge on top of the opening of the first compartment. This surface surrounding the openings of the first and second compartments may be used advantageously for welding (thermal or otherwise) or gluing on a cover suitable for closing off the openings in a leaktight and removable manner. Still further closure means may be used according to the invention.

According to a first embodiment, the first compartment has a central axis X, the second compartment has a central axis Y, and the articulation zone has two axes of articulation which are oriented perpendicularly to a plane passing through the axes X and Y and separated by a rigid to semi-rigid zone which is sufficiently wide to be able to bring the portion of the peripheral edge of the second compartment on top of the opening of the first compartment by moving the second compartment substantially in translation. This embodiment is advantageous in that it offers good guiding and good reproducibility of the movement of the compartment whose contents are to be poured into the other compartment. Such articulations may be arranged so as to permit or facilitate folding or pivoting in one direction more than in the other. The preferential folding or pivoting direction of the two axes of articulation may be the same or opposite.

By way of example, the two articulations consist of film hinges which are a particularly economical embodiment of the articulation zone used according to the present invention. Other types of articulation may instead be used. By way of a variant, the articulation zone consists of an unrolling hinge. Such an unrolling hinge may be formed from a flexible zone between the two compartments, i.e. a zone in which the width and the flexibility of the material forming it permit, firstly, a translation movement of the compartment whose contents have to be poured into the other compartment until a section of its peripheral edge is at least partly on top of the opening of the mixing compartment and, secondly, a tilting movement to enable the product to be poured into the mixing compartment. By way of illustration, a flexible zone of this type is in the form of a structure with corrugations or folds which are oriented perpendicularly to a plane passing through the axes X and Y of the first compartment and of the second compartment, respectively.

According to a further variant, the tray comprises two articulation zones formed by two strips located on either side of a plane passing through the axes X and Y of the first compartment and of the second compartment, respectively. Advantageously, each of the strips is connected to the first compartment by a first attachment line and to the second compartment by a second attachment line, the attachment lines being arranged opposite the respective lateral edges of the first and second compartments. This offers greater latitude, particularly in the horizontal component of the movement of the compartment whose contents are to be poured into the other, and furthermore makes it possible substantially to reduce the overall size of the device.

According to a further advantageous characteristic of the invention, the first compartment has fastening means (of the snap-fit bead type) capable of interacting with complementary means (of the groove type) borne by the other compartment so as to allow the two compartments to be fastened together when one is in a position in which it is folded over on the other, thereby producing a compact structure which forms both the primary and secondary packaging of the device. To this end it is possible to mount (by gluing or welding) the base of each of the compartments, individually, on a respective support made from cardboard or from plastic, for example, which acts as a protective element and as a labelling or marking support for certain technical and/or commercial information. In the folded position, the pieces of cardboard supporting each of the compartments respectively are located opposite each other. This is particularly advantageous from the standpoint of cost.

A tray of this type according to the invention may be produced by thermoforming or by thin-wall injection. It may be produced from a material chosen from polyethylenes (PE), polypropylenes (PP), polyvinyl chlorides (PVC), polystyrenes (PS), or from a complex of the PE/ethylene-vinyl alcohol copolymer (EVOH)/PE or PP/EVOH/PP type.

The products may be hair-care products. In particular, the product A may be an oxidizing agent and the product B a coloring agent. One or both of these products may be in the form of a powder, cream, gel, liquid or any other galenical form.

BRIEF DESCRIPTION OF THE DRAWINGS

Apart from the arrangements described above, the invention consists of a certain number of other arrangements which will be explained below by way of non-limiting illustrative embodiments described with reference to the appended figures, in which.

DETAILED DESCRIPTION OF THE PREFERRED EMBODIMENTS

Figure 1A:
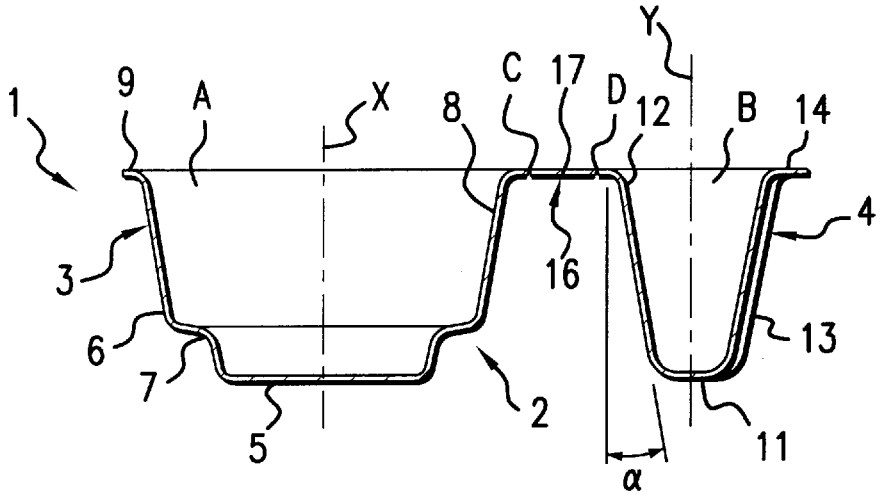
FIGS. 1A and 1B illustrate a first embodiment of the tray according to the invention.

FIG. 1A is a sectional view of a first embodiment of a tray 1 according to the invention. This tray includes a body 2 produced by thermoforming or thin-wall injection of materials such as polyethylenes (PE), polypropylenes (PP), polyvinylchlorides (PVC), polystyrenes (S), or from a complex of the PE/ethylene-vinyl alcohol copolymer (EVOH)/PE or PP/EVOH/PP type. The body 2 defines two compartments 3 and 4 which are intended to contain products A and B, respectively. The compartment 3 has a base 5, an opening 8 and lateral walls 6 which are slightly inclined with respect to its central axis X. In the vicinity of the base 5, the lateral walls 6 form an indentation 7 such that the section of the compartment 3 in the vicinity of the base 5 is smaller than the section of the compartment 3 in the vicinity of the opening. This indentation makes it possible to facilitate gripping of the tray via its base. The opening 8 of the compartment 3 is delimited by a peripheral edge 9 which forms a surface substantially parallel to the base 5, making it possible to fit a sealed (by gluing, welding or otherwise) cover 10. The compartment 4 has a base 11, an opening 12 and lateral walls 13 which are slightly inclined with respect to its central axis Y. The opening 12 of the compartment 4 is delimited by a peripheral edge 14 which forms a surface substantially parallel to the base 11, making it possible to fit a sealed (by gluing, welding or otherwise) cover 15.

Figure 1B:
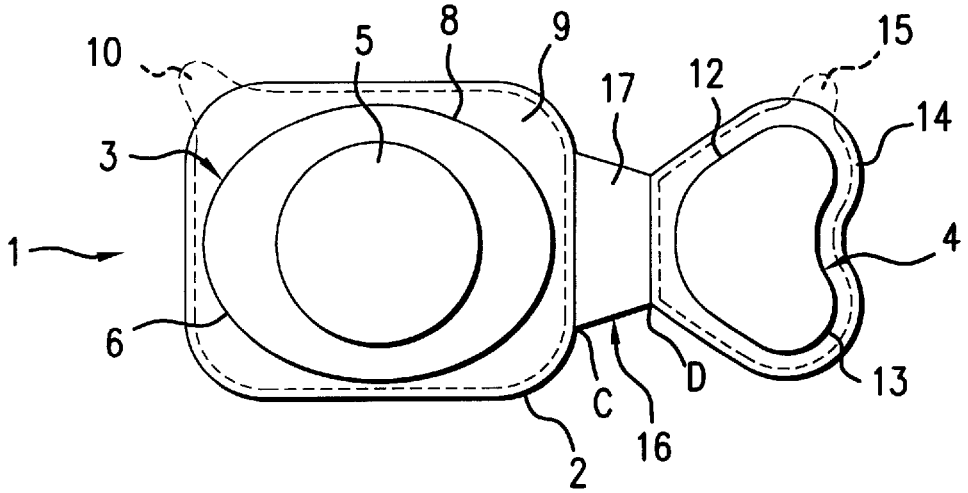

The two compartments 3 and 4 are connected together via an articulation zone 16 connecting the two compartments via their respective ends and having two axes of articulation C and D oriented substantially perpendicularly to the plane passing through the axes X and Y. Connected in this way, the two compartments are arranged end-to-end and have their respective bases located substantially in the same plane. The two axes of articulation are separated by a rigid or semi-rigid portion 17. In this embodiment, the axes of articulation are formed from film hinges which are formed from zones of lesser thickness. A plan view of the tray shown in section in FIG. 1 is shown in Figure 1B.

Figure 2A:
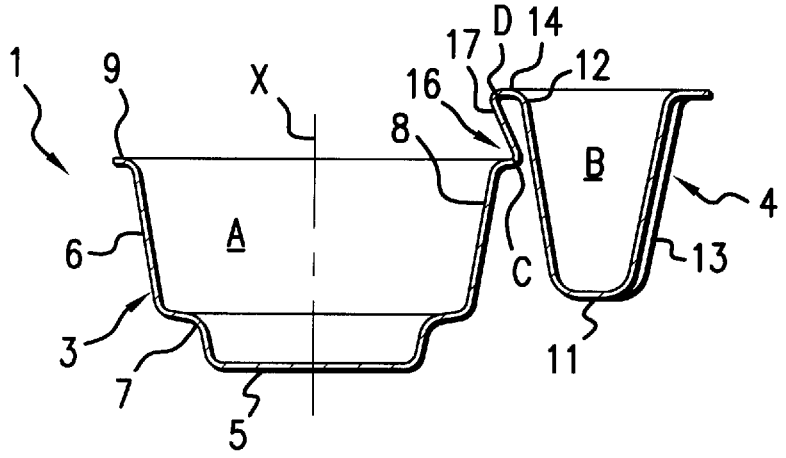
FIGS. 2A and 2B illustrate the use of a tray in accordance with FIGS. 1A and 1B for mixing two products A and B.
Figure 2B:
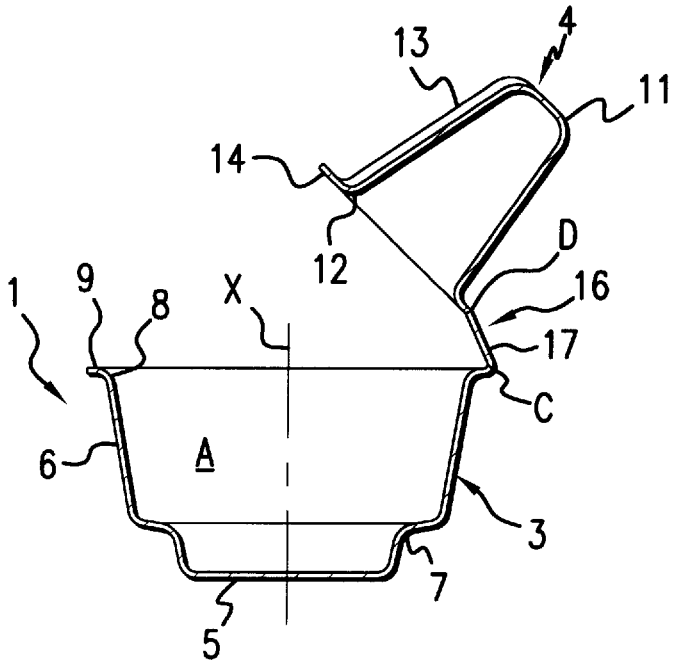

FIGS. 2A and 2B illustrate the operation and use of the tray according to the invention. In FIG. 2A, after the cover has been removed from the two compartments 3 and 4, the compartment 4 is raised by a movement which is substantially in translation into a position such that the portion of the peripheral edge 14 opposite the articulation zone 16 is located on top of the opening 8 of the compartment 3. Such a movement is permitted by a double folding or pivoting of the articulation zone around the axes C and D, and this double folding permitting a movement which has both a horizontal and a vertical component. Therefore, the edge of the compartment 4 may be brought on top of the opening 8 of the compartment 3 while the compartment 4 is kept substantially horizontal. The horizontal component of the movement is increased by the tilt of the wall 13 of the compartment 4. Typically, the angle of inclination of the wall may be between 5° and 45° and preferably between 5° and 20°. Such an inclination also facilitates the de-molding of the tray. The vertical component depends to a large degree on the width of the zone 17 located between the two axes of articulation C, D. Typically, this zone 17 may have a width of between 5 mm and 40 mm and preferably of between 10 mm and 30 mm.

In FIG. 2B, after having brought the edge of the compartment 4 on top of the compartment 3, the compartment 4 is tilted by being pivoted about the axis D. Thus, the product B is poured into the compartment 3 so as to be mixed with the product A. Depending on the galenical form of the product, provision may be made for accessories, of the spatula type, to promote the emptying of the compartment 4 into the compartment 3 and to facilitate the mixing of the two products.

Figure 3A:
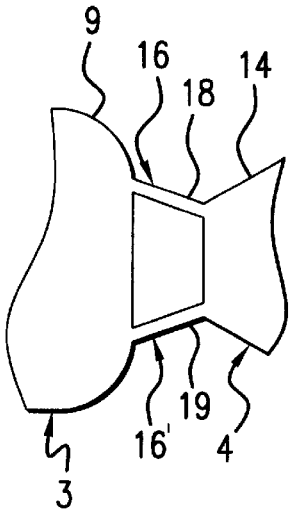
FIGS. 3A–3B and 4A–4C illustrate a number of variants of the articulation zone connecting the two compartments of the tray according to the invention.

In the embodiment in FIG. 3A, the compartments 3 and 4 are connected by two articulation zones 16, 16' formed by two flexible strips 18, 19 located on either side of the plane passing through the axes X and Y of the compartments 3 and 4. In this embodiment, the flexible strips 18, 19 converge in the direction of the compartment 4 relative to the plane passing through the axes X and Y. Each of the strips is arranged so as to allow the movement described with reference to FIGS. 2A and 2B. Owing to the relatively small width of the strips (typically of the order of 5 mm), their small thickness and the intrinsic flexibility of the material, this configuration has the advantage of allowing such a movement without a fixed axis of articulation, as in the embodiments in Figures 1A–1B and 2A–2B. An unrolling hinge is thus produced which makes it possible to bring the edge of the compartment 4 on top of the compartment 3, while holding the compartment 4 in a substantially horizontal position, and to tilt the compartment 4 so as to pour its contents into the compartment 3.

Figure 3B:
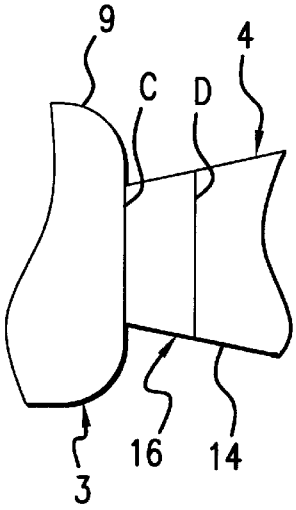

The articulation zone in FIG. 3B is similar to that in Figures 1A–1B and 2A–2B, i.e. it is formed from a single strip which is wider than the width of the strips in FIG. 3A. This configuration provides greater rigidity in terms of torsion than the configuration of FIG. 3A. Moreover, owing to the fixed axes of articulation C, D, the movement of the compartment 4 can be guided better, thereby limiting the risk of losing the product B when moving the compartment 4. Finally, this wider articulation zone acts as a screen when the contents of the compartment 4 are being poured into the compartment 3 so as to prevent, in the event of the product B being of relatively liquid consistency, the "teapot" effect.

Figure 4A:
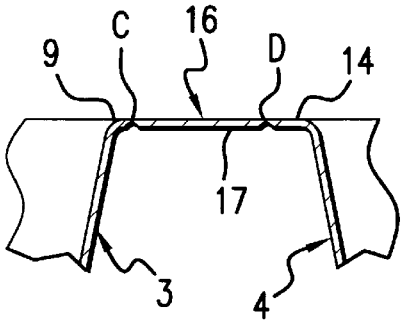
Figure 4B:
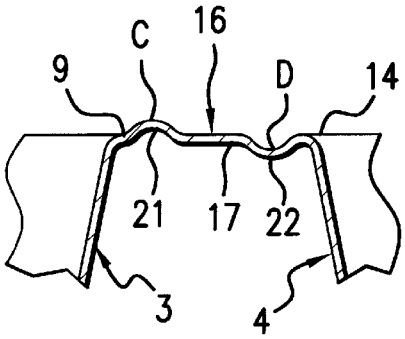
Figure 4C:
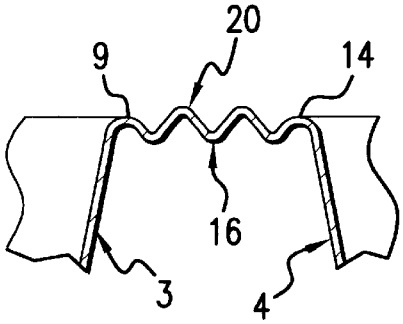

FIGS. 4A to 4C illustrate variants of the articulation zone 16. In the embodiment of FIG. 4A, the articulation zone is formed by two film hinges produced by molding or deep drawing and separated by a rigid or semi-rigid zone 17. In this embodiment, the film hinges have a preferential folding direction about their respective axis. In this embodiment the two film hinges have the same preferential direction of pivoting or folding about the axis C or D, respectively.

In FIG. 4B, the zone 16 separates two articulations formed from two folds or corrugations 21, 22 which are obtained when the tray is molded. The folds are oriented perpendicularly to the plane passing through the axes X and Y of the compartments 3 and 4 and do not face each other, allowing preferential folding in a first direction about the axis C and in the opposite direction about the axis D. Thus, advantage is taken of the facility of folding about each of the axes C, D and, by virtue of elastic recall, the return of the compartment 4 into its initial position after its contents have been mixed with those of the compartment 3 is promoted.

In FIG. 4C, the articulation zone is produced by a zone with corrugations 20 produced when the tray 1 is molded. The number of folds can vary as a function of the width of the zone 16 and as a function of the desired flexibility. Such a configuration makes it possible to give greater flexibility to the approach movement of the compartment 4 over the compartment 3.

Figure 5:
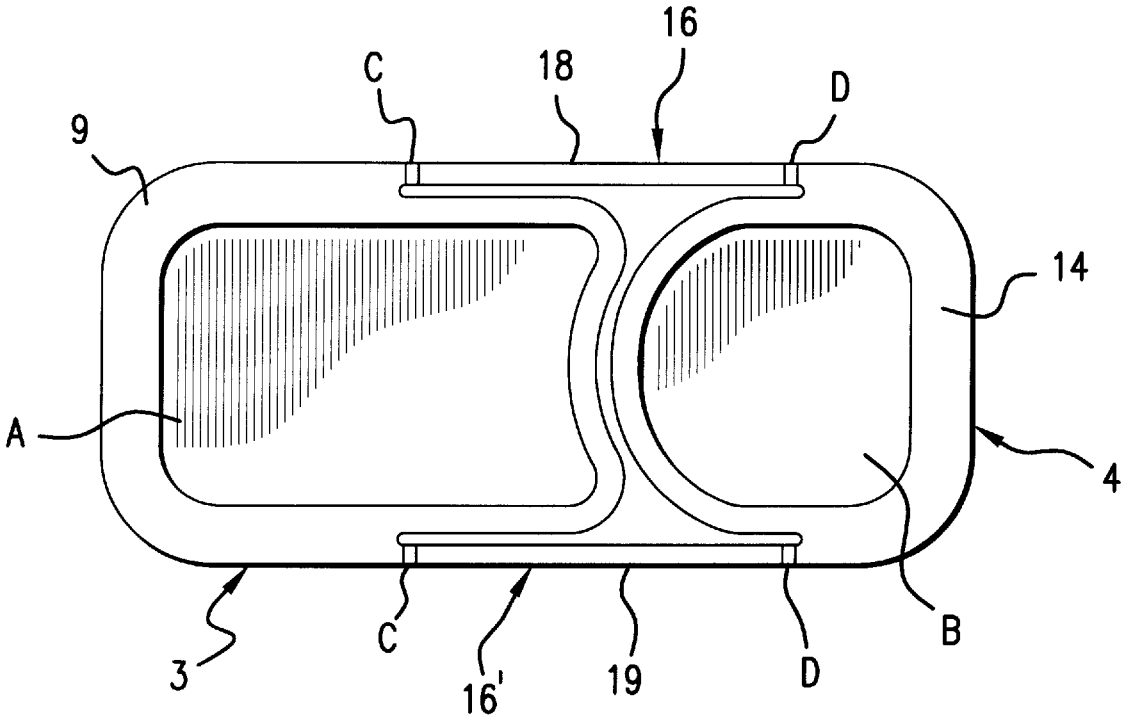
FIG. 5 is a top view of a further embodiment of the tray according to the invention.

FIG. 5 illustrates a further embodiment of the tray according to the invention, which is a variant of the embodiment in FIG. 3A. According to this embodiment, the compartment 3 and the compartment 4 are connected by two articulation zones 16 and 16' which are each formed by narrow strips 18 or 19, respectively (typically of the order of 5 mm), and the attachment lines on each of the compartments 3, 4 are located opposite the lateral edges of each of the compartments, unlike the embodiment in FIG. 3A in which the attachment lines were located on the ends of the compartments. In this embodiment, the attachment lines are located substantially in the center of the respective lateral edges of each of the compartments 3 and 4. Substantially in the vicinity of its attachment lines, each of the strips has two articulations C, D formed by film hinges, for example. As shown in the embodiment in FIG. 3A, the fixed axes of articulation C, D are not essential if the strips 18 and 19 are sufficiently narrow and flexible. In the same way as for the other embodiments, the compartment 4 is brought on top of the compartment 3 by pivoting firstly about the axis C and secondly about the axis D so as to keep the compartment 4 substantially horizontal. The contents of the compartment 4 are then poured into the compartment 3 by tilting the compartment 4 about the axis D. This configuration is particularly advantageous in that it allows greater latitude, particularly in the horizontal component of the approach movement of the compartment 4. In the embodiment illustrated, the edge of the compartment whose contents are to be poured out may be brought substantially into the center of the mixing compartment, thereby promoting the pouring of the product B into the compartment 3. Moreover, it allows a substantial reduction in the overall size of the tray.

In the preceding detailed description, reference was made to preferred embodiments of the invention. Obviously, variants of the invention may be provided without departing from the spirit of the invention as claimed below.

I claim:

1. A thermoplastic tray comprising:

a thermoplastic body forming at least two compartments of which a first compartment contains a first product and a second compartment contains a second product, each of the first and second compartments having an opening delimited by a peripheral edge;

removable means for closing the openings of the first and second compartments; and at least one articulation zone connecting the two compartments together, wherein said articulation zone has such a size and configuration that at least a portion of the peripheral edge of the second compartment may be brought vertically above the opening of the first compartment while keeping the peripheral edges of said compartments oriented substantially horizontal by translationally moving one of the first and second compartments, and wherein said articulation zone is configured to permit the second compartment located vertically above the opening of the first compartment to be tilted so as to pour the product therein into the first compartment.

2. The tray according to claim 1, wherein said second compartment has a lateral wall of which at least a portion adjacent to said articulation zone is inclined.

3. The tray according to claim 2, wherein said inclined portion of the lateral wall is inclined by an angle of from 5° to 45°.

4. The tray according claim 1, wherein the peripheral edge delimiting said opening of at least said second compartment forms a surface which is substantially parallel to a plane of a base of the second compartment, and wherein said portion of the peripheral edge of the second compartment which may be brought vertically above the opening of the first compartment is an end of said surface connecting to the articulation zone.

5. The tray according to claim 1, wherein said articulation zone has two axes of articulation, each of which is oriented perpendicularly to a plane passing through the central axes of said compartments, said axes of articulation being separated by a substantially rigid zone which is sufficiently wide to permit the portion of the peripheral edge of the second compartment to be brought vertically above the opening of the first compartment while keeping the peripheral edges of said compartments oriented substantially horizontal.

6. The tray according to claim 5, wherein each of the two axes of articulation has a preferential folding or pivoting direction, the two axes of articulation having the same preferential direction.

7. The tray according to claim 5, wherein the two axes of articulation each comprises a film hinge.

8. The tray according to claim 1, wherein the articulation zone comprises an unrolling hinge.

9. The tray according to claim 8, wherein the unrolling hinge comprises at least one flexible zone between the two compartments.

10. The tray according to claim 9, wherein the flexible zone comprises a structure with corrugations or folds which are oriented perpendicularly to a plane passing through the central axes of the first and second compartments.

11. The tray according to claim 1, including two of said articulation zones formed by two strips located on either side of a plane passing through the central axes of the first compartment and of the second compartment, respectively.

12. The tray according to claim 11, wherein each of the strips is connected to the first compartment by a first attachment line and to the second compartment by a second attachment line, said attachment lines being arranged opposite the respective lateral edges of the said first and second compartments.

13. The tray according to claim 1, formed by thermoforming or thin-wall injection.

14. The tray according to claim 1, wherein the first compartment has fastening means for interacting with complementary means borne by the second compartment so as to allow the two compartments to be fastened together when one is folded over onto the other.

15. The tray according to claim 1, formed from a material chosen from one of polyethylenes (PE), polypropylenes (PP), polyvinyl chlorides (PVC), polystyrenes (PS), a complex of the PE/ethylene-vinyl alcohol copolymer (EVOH)/PE type, and a complex of the PP/EVOH/PP type.

16. The tray according to claim 4, wherein said removable means for closing comprise a cover which is adhered along said surface formed by the peripheral edge of said opening.

17. The tray according to claim 1, wherein said products are hair-care products.

18. The tray according to claim 16, wherein one of the products is an oxidizing agent and the other of the products is a coloring agent.

19. The tray according to claim 2, wherein said inclined portion of the lateral wall is inclined by an angle of from 5° to 20°.

20. The tray according to claim 5, wherein each of the two axes of articulation has a preferential folding or pivoting direction, the two axes of articulation having opposite preferential directions.

* * * * *